US007381513B2

(12) United States Patent
Suzuki et al.

(10) Patent No.: US 7,381,513 B2
(45) Date of Patent: Jun. 3, 2008

(54) CARRIER, DEVELOPER, IMAGE FORMING METHOD AND PROCESS CARTRIDGE FOR ELECTROSTATIC IMAGE DEVELOPMENT

(75) Inventors: Kohsuke Suzuki, Numazu (JP); Tomio Kondoh, Numazu (JP); Shinichiro Yagi, Numazu (JP); Hitoshi Iwatsuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 11/189,692

(22) Filed: Jul. 27, 2005

(65) Prior Publication Data

US 2006/0024606 A1 Feb. 2, 2006

(30) Foreign Application Priority Data

Jul. 29, 2004 (JP) ..... 2004-221546

(51) Int. Cl.
*G03G 9/113* (2006.01)

(52) U.S. Cl. ..... 430/111.35; 430/111.32; 430/111.33; 430/123.58

(58) Field of Classification Search ..... 430/111.32, 430/111.33, 111.35, 123.58; 399/111
See application file for complete search history.

(56) References Cited

U.S. PATENT DOCUMENTS

| | | | | |
|---|---|---|---|---|
| 5,744,275 | A * | 4/1998 | Duggan et al. | 430/111.32 |
| 6,134,413 | A * | 10/2000 | Asanae et al. | 399/267 |
| 6,159,648 | A * | 12/2000 | Baba et al. | 430/110.4 |
| 2002/0022190 | A1 | 2/2002 | Iizuka et al. | |
| 2003/0118366 | A1* | 6/2003 | Nukada et al. | 399/109 |
| 2003/0180643 | A1 | 9/2003 | Suzuki et al. | |

FOREIGN PATENT DOCUMENTS

| | | |
|---|---|---|
| EP | 1 030 224 A1 | 8/2000 |
| JP | 41-20153 | 11/1941 |
| JP | 43-27596 | 11/1943 |
| JP | 44-6397 | 3/1944 |
| JP | 45-26478 | 9/1970 |
| JP | 54-155048 | 12/1979 |
| JP | 55-42752 | 11/1980 |
| JP | 57-040267 | 3/1982 |
| JP | 58-108548 | 6/1983 |
| JP | 58-108549 | 6/1983 |
| JP | 59-7385 | 2/1984 |
| JP | 59-166968 | 9/1984 |
| JP | 1-19584 | 4/1989 |
| JP | 3-628 | 1/1991 |
| JP | 06-202381 | 7/1994 |
| JP | 07-140723 | 6/1995 |
| JP | 08-006307 | 1/1996 |
| JP | 08-179570 | 7/1996 |
| JP | 08-286429 | 11/1996 |
| JP | 09-160304 | 6/1997 |
| JP | 2683624 | 8/1997 |
| JP | 10-333363 | 12/1998 |
| JP | 3120460 | 10/2000 |

OTHER PUBLICATIONS

U.S. Appl. No. 11/449,808, filed Jun. 9, 2006, Suzuki et al.
U.S. Appl. No. 11/378,424, filed Mar. 20, 2006, Suzuki et al.
U.S. Appl. No. 11/270,731, filed Nov. 10, 2005, Suzuki et al.
U.S. Appl. No. 11/870,613, filed Oct. 11, 2007, Iwatsuki et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A carrier containing a core material and a resin coating layer located overlying the surface of the core material. The resin coating layer contains resin and electroconductive particles having an oil absorption amount of from 10 to 300 ml/100 g. The electroconductive particle contains a base material particle and an electroconductive coating layer located overlying the surface of the base material particle. The electroconductive coating layer contains an underlayer containing tin dioxide and an upper layer containing indium oxide and tin dioxide, located overlying the underlayer.

16 Claims, 1 Drawing Sheet

FIGURE
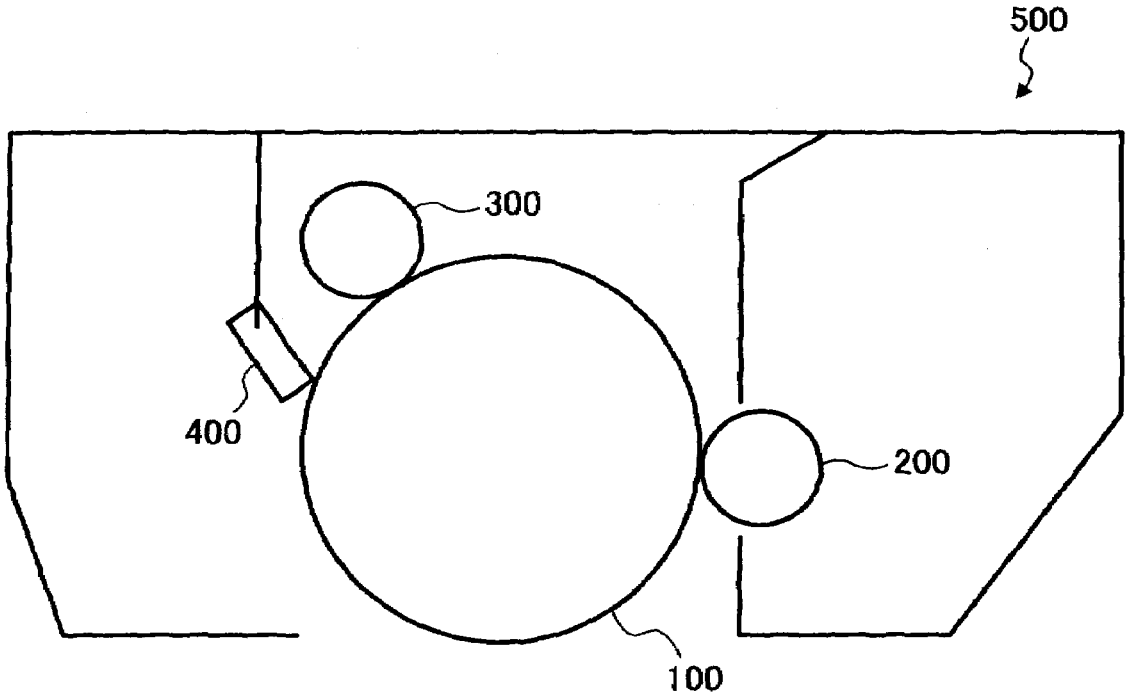

CARRIER, DEVELOPER, IMAGE FORMING METHOD AND PROCESS CARTRIDGE FOR ELECTROSTATIC IMAGE DEVELOPMENT

BACKGROUND OF THE INVENTION

1. Field of the Invention

The present invention relates to a carrier for use in electrostatic image development performed in electrophotography, electrostatic recording, and electrostatic printing, etc., and further relates to a developer containing the carrier, an image forming apparatus and a process cartridge using the carrier or the developer.

2. Discussion of the Background

Image forming methods for use in electrophotography typically include the following processes:

(1) Forming a latent electrostatic image on an image bearing member formed of, for example, a photoconductive material;

(2) Attaching charged toner particles to the latent electrostatic image to form a visualized toner image;

(3) Transferring the visualized toner image to a recording material such as paper; and (4) Fixing the visualized toner image on the recording material before discharging the recording material outside;

Recently, the technology for use in photocopiers and printers using electrophotography has been rapidly extending from monochrome photocopying or printing to color photocopying or printing. Therefore the full color photocopier and printer market is expanding.

In color image forming based on full color electrophotography, all colors are typically reproduced by overlapping the layers of the three primary color toners, i.e., yellow, magenta and cyan toner, or of four color toners including the three primary color toners and black toner. To obtain a vivid and clear full color image having a good reproducibility, it is necessary to reduce light scattering by smoothing the surface of a fixed toner image to some degree. Because of this, typical full color photocopiers, etc. produce images having a gloss in the medium to high range, i.e., 10 to 50% in most cases.

As a method of fixing a dry toner image on a recording medium, a contact heating fixing method in which a roller or a belt having a smooth surface is heated to fix toner upon application of heat and pressure is normally adopted in many cases. This method is thermally efficient and fixes toner at a high speed, thereby providing gloss and transparency to color toner. To contrary to this advantage, offset phenomenon, in which part of a toner image attaches to the surface of a fixing roller and transfers to another image, occurs because the surface of the heated fixing roller is press-contacted with melted toner before detachment.

To prevent this offset phenomenon, a countermeasure has been adopted in which the surface of a fixing roller is formed of a material having a good releasability such as silicone rubber and fluorine containing resin and further a releasing oil such as silicone oil is applied to the surface of the fixing roller. Although this countermeasure is extremely effective to prevent toner offset, a device to supply a release oil is extra required, thereby increasing the size of a fixing device. Therefore, this is not suitable in terms of reduction in size as a whole. Therefore, as for a monochrome toner, another method is instead adopted in which no or a little amount of release oil is applied to a fixing roller (hereinafter referred to as oilless method). In such an oilless method, viscosity and elasticity of a melted toner are increased by adjusting molecular weight distribution of a binder resin to prevent inside rupture of the melted toner and further a release agent such as wax is contained in the toner.

In addition, oilless methods are also increasingly adopted for color toners as well as monochrome toners in terms of the size reduction and simplification of a machine. However, as mentioned above, in the case of a color toner, it is necessary to smooth the surface of an unfixed image to improve the color reproduction. Therefore, it is inevitable to reduce the viscosity and elasticity of a toner during melting. That is, relative to the case of a monochrome toner having a relatively low gloss, a color toner tends to offset so that it is difficult to adopt the oilless method mentioned above for a fixing device. In addition, when a release agent is contained in a toner, the attachment property of the toner is strengthened. As a result, the transferability of the toner to a transfer medium deteriorates. Further, this causes a problem that the release agent contained in the toner contaminates a friction charging member such as a carrier and reduces the chargeability of the friction charging member, resulting in deterioration of the durability of the friction charging member.

On the other hand, a carrier has a hard coating layer formed of a suitable resin material to prevent filming of toner components on the surface of the carrier, oxidization of the surface of the carrier, deterioration of humid sensitivity of the carrier, and the attachment of the carrier to the surface of an image bearing member, to prolong the life of a developer containing the carrier, to protect an image bearing member from being scratched or abraded by the contact with the carrier, and to control the charging polarity or adjust the amount of charge in the carrier. For example, unexamined published Japanese patent application No. (hereinafter referred to as JOP) 58-108548 describes a carrier covered with a specific resin material. JOP 54-155048, 57-40267, 58-108549, 59-166968, and H6-202381, and examined published Japanese patent applications Nos. (hereinafter referred to as JPP) H3-628 and H119584 describe a coating layer of a carrier to which various kinds of additives are attached. JOP 5-273789 describes a carrier, to the surface of which an additive is attached. JOP H9-160304 describes a carrier having a coating layer which contains electroconductive particles having a diameter larger than the thickness of the coating layer. In addition, JOP H8-6307 describes a carrier having a coating layer mainly formed of a benzoguanamine-n-butyl alcohol-formaldehyde copolymer and Japanese Patent No. 2683624 describes a carrier having a coating layer formed of a cross-linkage compound of a melamine resin and an acrylic resin.

However, these carriers do not still have sufficient durability and cannot sufficiently restrain carrier attachment. Problems related to the durability are, for example, toner spent on the surface of the carrier, unstable charging state due to the toner spent, reduction in the thickness of coating layer due to scraping of the coated resin, and decrease in resistance due to the reduction in the thickness of the coated resin. Initially good images can be obtained but as the number of copies increases, quality of the images obtained deteriorates. This is a problem to be solved.

In addition, as the demand to make it faster and more beautiful is stronger, the speed of machines has recently become significantly faster. With this increase in the speed of machines, the stress on a developer greatly increases. Thereby, the life length of a carrier, which is normally sufficiently long, becomes short for a practical use. Further, carbon black has been typically used as a resistance adjuster for a carrier in many cases. This creates a concern that carbon black may transfer to a color image and cause color contamination due to layer scraping and/or detachment of carbon black. Various kinds of countermeasures have been proposed and have effects on prevention of such color contamination.

For example, JOP H07-140723 proposes a carrier including electroconductive material (i.e., carbon black) present on the surface of the core material but not in a resin coating layer. In addition, JOP H08-179570 proposes a carrier including a resin coating layer having a density gradient. The density thereof goes thinner toward the surface of the resin coating layer and carbon black is not present on the surface of the resin coating layer. Further, JOP H08-286429 proposes a double-layer coating type carrier which has an inner coating layer containing electroconductive carbon on the surface of a core particle and another layer, i.e., surface coating resin layer, containing white color electroconductive material, on the inner coating layer. However, these carriers cannot deal with high stress on developers and thus the color contamination problem remains unsolved.

It is apparent that removing carbon black, which is a root cause of color contamination, is most effective to solve this color contamination problem. However, since carbon black has a low electric resistance, the resistance of a carrier rises when carbon black is simply removed. Commonly, when a carrier having a high electric resistance is used in a developer for a photocopying image having a large area, obtained images have a sharp edge effect, meaning that the image density is extremely thin at the center portion and thick only at the edge portion.

In addition, when an image is formed of characters and fine lines, a vivid image is obtained because of this edge effect. But when an image has an intermediate tone, there is a drawback in that obtained images have extremely poor reproducibility.

Generally, as resistance adjuster other than carbon black, for example, titanium oxide and zinc oxides are known. However, these compounds do not have the same effect as carbon black with regard to lowering the resistance of a carrier. This problem remains unsolved.

SUMMARY OF THE INVENTION

Because of these reasons, the present inventors recognize that a need exists for a carrier and a developer having a good durability with which images having fine reproducibility can be obtained without the edge effect and color contamination.

Accordingly, an object of the present invention is to provide a long life carrier and developer by which vivid and clear images having a fine reproducibility without the edge effect and color contamination can be obtained, and a further object is to provide an image forming method and a process cartridge using the long life carrier and developer.

Briefly these objects and other objects of the present invention as hereinafter will become more readily apparent and can be attained by a carrier containing a core material, and a resin coating layer located overlying the surface of the core material. The resin coating layer contains resin and electroconductive particles having an oil absorption amount of from 10 to 300 ml/100 g. The electroconductive particles contain a base material particle and an electroconductive coating layer located overlying the surface of the base material particle. The electroconductive coating layer contains an underlayer containing tin dioxide, and an upper layer containing indium oxide and tin dioxide, which is located overlying the under layer.

It is preferred that, in the carrier mentioned above, the base material particle of the electroconductive particle contains at least one of aluminum oxide, titanium dioxide, zinc oxide, silicon dioxide, barium sulfate, and zirconium oxide.

It is still further preferred that, in the carrier mentioned above, the electroconductive particles have a powder specific resistance not greater than 200 Ωcm.

It is still further preferred that, in the carrier mentioned above, the content of the electroconductive particles is from 10 to 70 weight % based on the total weight of the resin coating layer.

It is still further preferred that, in the carrier mentioned above, the resin coating layer further contains non-electroconductive particles.

It is still further preferred that, in the carrier mentioned above, the content A of the electroconductive particles and the content B of the non-electroconductive particles are from 10 to 70 weight % based on the total weight of the resin coating layer.

It is still further preferred that, in the carrier mentioned above, the content ratio of the electrocondcutive particles to the non-electroconductive particles is from 1/9 to 7/3.

It is still further preferred that the carrier has a volume resistivity of from 10 to 16 [Log(Ωcm)].

It is still further preferred that the carrier has a weight average particular diameter of from 20 to 65 μm.

It is still further preferred that, in the carrier mentioned above, the resin coating layer contains at least one of silicone resin and acrylic resin.

It is still further preferred that, in the carrier mentioned above, the ratio (D/h) of the particle diameter (D) of the electroconductive particle to the thickness (h) of the resin coating layer satisfies the following relationship: $1<(D/h)<10$.

It is still further preferred that, the magnetic moment of the carrier mentioned above is from 40 to 90 ($Am^2/Kg$) for 1,000 Oe or $1,000/4\pi$ (A/m).

It is still further preferred that, in the carrier mentioned above, the surface of the electroconductive particle is treated by a silane-coupling agent, and the amount of carbon in the electroconductive particle is from 0.1 to 0.5 weight %.

As another aspect of the present invention, a developer is provided which contains a toner containing a binder resin, and a colorant and a carrier. The carrier containing a core material, and a resin coating layer located overlying the surface of the core material. The resin coating layer contains resin and electroconductive particles having an oil absorption amount of from 10 to 300 ml/100 g. The electroconductive particles contain a base material particle and an electroconductive coating layer located overlying the surface of the base material particle. The electroconductive coating layer contains an underlayer containing tin dioxide, and an upper layer containing indium oxide and tin dioxide, which is located overlying the under layer.

It is preferred that, in the developer mentioned above, the toner is a color toner.

As another aspect of the present invention, an image forming method is provided which contains the steps of forming a latent electrostatic image on an image bearing member, visualizing the latent electrostatic image with a developer, transferring the visualized image to a recording material, and fixing the visualized image. The developer contains a toner containing a binder resin, and a colorant and a carrier. The carrier containing a core material, and a resin coating layer located overlying the surface of the core material. The resin coating layer contains resin and electroconductive particles having an oil absorption amount of from 10 to 300 ml/100 g. The electroconductive particles contain a base material particle and an electroconductive coating layer located overlying the surface of the base material particle. The electroconductive coating layer contains an underlayer containing tin dioxide, and an upper layer containing indium oxide and tin dioxide, which is located overlying the under layer.

As another aspect of the present invention, a process cartridge is provided which contains an image bearing member, a developing device configured to hold a developer, and optionally at least one of a charging member configured to charge the image bearing member and a cleaning member configured to remove residual toner on the image bearing member. The developer contains a toner containing a binder resin, and a colorant and a carrier. The carrier containing a core material, and a resin coating layer located overlying the surface of the core material. The resin coating layer contains resin and electroconductive particles having an oil absorption amount of from 10 to 300 ml/100 g. The electroconductive particles contain a base material particle and an electroconductive coating layer located overlying the surface of the base material particle. The electroconductive coating layer contains an underlayer containing tin dioxide, and an upper layer containing indium oxide and tin dioxide, which is located overlying the under layer.

It is preferred that the process cartridge mentioned above contains the charging member.

It is still further preferred that the process cartridge first mentioned contains the cleaning member.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic diagram illustrating an example of the structure of a process cartridge of the present invention.

DETAILED DESCRIPTION OF THE INVENTION

The present invention will be described below in detail with reference to several embodiments and accompanying drawing.

As a result of the intensive study on solutions to the drawbacks on the background art mentioned above by the inventors of the present invention, the inventors of the present invention have found that a carrier has a significant improvement effect which is formed of a core material and a resin coating layer on the surface thereof which contains electroconductive particles. The electroconductive particle has a base material particle, an underlayer containing tin dioxide located overlying the core particle, and an upper layer containing indium oxide and tin dioxide located overlying the underlayer. The term "overlying" represents above and can also include, but does not require, in contact with". In addition, the electroconductive particle has an oil absorption amount of from 10 to 300 ml/100 g, preferably from 10 to 200 ml/100 g, more preferably from 12 to 100 ml/100 g and particularly preferably from 15 to 60 ml/100 g. This is thought to be effective because, since the electroconductive particle has the structure in which the underlayer containing tin dioxide is provided on the surface of the base material particle and the upper layer containing indium oxide and tin dioxide functioning as an electroconductive layer is provided on the underlayer by a suitable method, the upper layer can be firmly and uniformly fixed on the surface of the particle so that the particle can have a sufficient resistance adjustment effect.

Further, it is important that the oil absorption amount is limited within the range mentioned above. When the oil absorption amount is too small, the electroconductive particle may not have a sufficient compatibility with the coating resin of the carrier. Therefore, the attachment property between the electroconductive particle and the coating resin may not be good and the dispersion property of the electroconductive particle may be poor. As a result, the electroconductive particle is possibly difficult to maintain its resistance adjustment effect over an extended period of time. When the oil absorption amount is too large, the attachment force between the electroconductive particle and the coating resin may be too strong so that the electroconductive particle is completely covered with the coating resin. Thereby the electroconductive particle does not exert its resistance adjustment effect.

The method of forming the electrocondcutive layer mentioned above is preferably, for example, to cover the surface of a core particle with a hydrate of tin dioxide; subsequently, to cover the resultant with a hydrate of indium oxide including a hydrate of tin dioxide; and to heat the resultant in the range of 300 to 800° C. in an inactive gas atmosphere, but are not limited thereto. In addition, the oil absorption amount of the electroconductive particle can be adjusted by changing the average primary particle diameter and BET specific area of the base material particle, and the thickness of the coated electroconductive layer.

The method of measuring the oil absorption amount in the present invention is according to "21. Oil absorption" of "JIS K 5101 Method of test for pigments". Gross outline of the method is as follows; set a sample material on a smooth glass plate; drop boiled linseed oil on the center portion thereof 4 to 5 droplets by droplets; fully knead the resultant with a spatula; repeat the processes of dropping and kneading until the entire portion has a hard putty form; then drop the droplet thereof one by one and perform kneading in the same way until the kneaded material can be spirally wound with the spatula. The calculation method of the oil amount is as follows:

$$OA = V/m \times 100 \text{ (ml/100 g)}$$

wherein OA (ml/100 g) represents the oil absorption amount, m (g) represents the weight of the sample material and V (ml) represents the amount of dropped boiled linseed oil.

Further, when the base material particle of the electroconductive particle includes at least one of aluminum oxide, titanium dioxide, zinc oxide, silicon dioxide, barium sulfate and zirconium oxide, the improvement effect is significant. This is thought to be because these materials have a good affinity to the electroconductive treatment of the surface of a particle so that the electroconductive treatment effect is greatly exercised. The base material particles of the electroconductive particle which can be used in the present invention are not limited to the particles of these compounds mentioned above and other compounds which can exert an excellent effect can also be used.

Further, the improvement effect is significant when the electrocondcutive particle has a powder specific resistance not greater than 200 (Ωcm). This is because, since the electroconductive particle is included to adjust resistance, the electroconductive particle is necessary to effectively reduce the resistance.

The electroconductive particle has an electroconductive coating layer which has been treated by silane coupling agent. The electroconductive particle preferably has an amount of carbon from 0.1 to 0.5 weight %, more preferably from 0.1 to 0.4 weight %, and particularly preferably from 0.2 to 0.4 weight % based on the weight of the electroconductive particle including after the silane coupling agent treatment.

When the amount of carbon is too small, the surface treatment of the electrocondcutive particle by silane coupling agent is not perfect so that the resistance of the electroconductive particle changes over time due to intrusion of oxygen and humidity. As a result, the resistance of the carrier may change. To the contrary, when the amount of carbon is too large, the surface of the electroconductive particle is so completely covered by silane coupling agent surface treatment that the silane coupling agent treatment layer functions as insulating body against the electroconductive layer. Thereby, the electroconductive particle may lose electroconductivity, meaning that electronconductivity particle cannot exercise resistance adjustment effect. In addition, brightness of color deteriorates so that whiteness may be lost.

Suitable treatment on the layer of the electroconductive particle mentioned above represents from 0.2 to 0.6 weight %/($m^2$/g) but is not limited thereto.

The amount of carbon in the present invention can be measured by using IR-212 manufactured by Leco Corporation. The method is as follows: weigh 0.5 g of the test portion in a ceramic crucible; add two combustion improvers, i.e., LEOCEL II and IRON CHIP ACCELERATOR, into the ceramic crucible; set the ceramic crucible in the device for measuring; and determine the data obtained after measurement as the amount of carbon.

Specific detailed manufacturing methods of electroconductive particles suitable for the present invention include the following:

As for forming the underlayer, i.e., a layer of a hydrate of tin dioxide, various kinds of methods can be mentioned. For example, there are a method in which a solution of tin salt or tin acid salt is added to an aqueous suspension of white inorganic pigments and an alkali or an acid is added thereafter, and another method in which a tin salt or a tin acid salt, and an alkali or an acid are separately added in parallel. To uniformly coat a hydrate of tin oxide on the surface of the white inorganic pigment particle, the latter method, i.e., the separate and parallel addition method, is preferred and at the time it is more preferred the aqueous suspension of the white in organic pigments is heated and maintained at 50 to 100° C. In addition, pH is from 2 to 9 when a tin salt or a tin acid salt, and an alkali or an acid is separately added in parallel. Since the isoelectric point of hydrate of tin dioxide is achieved when pH is 5.5, it is important and preferred to maintain pH in the range of from 2 to 5 or 6 to 9. Thereby, a hydrolytic reaction product of tin can be uniformly deposited on the surface of a white inorganic pigment particle.

Specific examples of such tin salts include tin chloride, tin. sulfate, and tin nitric acid. As for tin acid salts, natrium stannate, potassium stannate, etc., can be used.

As for such alkalis, for example, natrium hydroxide, potassium hydroxide, natrium carbonate, potassium carbonate, ammonium carbonate, ammonia water and ammonia gas can be used. As for such acids, for example, hydrochloric acid, sulfuric acid, nitric acid, acetic acid, etc. can be used.

The coating amount of a hydrate of tin dioxide is from 0.5 to 50 weight % and preferably from 1.5 to 40 weight % in the form of $SnO_2$, based on the base material particle, i.e., white inorganic pigment. When this coating amount is too small, the coated state of hydrate of indium oxide including tin dioxide which is coated on the underlayer is non-uniform. In addition, the underlayer tends to be affected by the inorganic pigment of the base material particle and the powder volume resistivity becomes high. In contrast, when the coating amount is too large, the content of the hydrate of tin oxide which is not adhered to the surface of the inorganic pigment particle of the base material particle increases, resulting in non-uniform coating.

There are various kinds of coating the upper layer, i.e., a hydrate of indium oxide including tin dioxide. To prevent dissolution of the layer of the hydrate of tin dioxide which has already coated, it is preferred to form the upper layer by separately adding a mixture solution of a tin salt and an indium salt and an alkali in parallel. During addition, it is preferred to heat the aqueous suspension at 50 to 100° C. In addition, pH during the parallel addition of the mixture solution and the alkali is necessary to be maintained from 2 to 9, preferably from 2 to 5 or 6 to 9. Thereby, the product of hydrolytic reaction of tin and indium can be uniformly attached.

Specific examples of materials for tin include tin chloride, tin sulfate, and tin nitric acid. Specific examples of materials for indium include indium chloride and indium sulfate.

The addition amount of tin dioxide is 0.1 to 20 weight % and preferably from 2.5 to 15 weight % in the form of $SnO_2$ based on $In_2O_3$. Desired electroconductivity can be obtained only in this range.

The addition amount of indium oxide is from 5 to 200 weight % and preferably from 8 to 150 weight % in the form of $In_2O_3$ based on the inorganic pigment of a base material particle. When the addition amount is too small, it is not possible to obtain the desired electroconductivity. In contrast, when the addition amount is too large, the electroconductivity improves little while increasing cost, which is not preferred.

In this specification, the "electroconductive" powder represents a powder having a volume resistivity of from 1 to 500 Ωcm. As shown in examples described later, a white electrocondcutive powder having greatly excellent electroconductivity, i.e., not greater than 100 Ωcm, which is equivalent to the electroconductivity of a product containing stibium, or even not greater than 10 Ωcm, can be obtained.

When the electroconductive powder is subject to heat treatment, it is preferred to heat the electroconductive powder at 350 to 750° C. in a non-oxidation atmosphere. Such an electroconductive powder which is heated in a non-oxidation atmosphere can have a powder volume resistivity two to three digit smaller than that of an electroconductive powder which has been heated in a normal atmosphere.

To obtain a non-oxidation atmosphere, inert gases can be used. Specific examples of such inert gases include nitrogen, helium, argon and carbonate gas. From an industrial point of view, heating an electroconductive powder while blowing in nitrogen gas is cost effective and it is possible to obtain a product having stable characteristics.

The heating temperature is from 350 to 700° C. and preferably from 400 to 700° C. When the heating temperature is outside this range, desired electroconductivity is difficult to obtain. In addition, when the heating time is too short, there is no heating effect. In contrast, when the heating time is too long, no extra effect can be expected. Therefore, suitable heating time is from about 15 minutes to about 4 hours and preferably from about 1 hour to about 2 hours.

The obtained baked product is pulverized and a predetermined amount of silane coupling agent is added while the pulverized resultant is stirred. Thereafter, the resultant is heated at 90 to 120° C. for 1 hour. Specific examples of such silane coupling agents include amino-based silane coupling agents, methacryloxy-based silane coupling agents, vinyl-based silane coupling agents and mercapto-based silane coupling agents.

Further, the improvement effect is significant when a resin coating layer containing non-electroconductive particles is contained. Thereby, it is possible to secure the latitude of a resin coating layer so that the form of the surface of a carrier and characteristics of the resin coating layer can be easily controlled. That is, it is possible to adjust the resistance by simultaneously using electroconductive particles and non-electroconductive particles in a balanced manner while maintaining the form of the surface of a carrier and the layer strength of a resin coating layer. The non-electroconductive particle represents, for example, an inorganic oxidized particle and a resin particulate and also includes the compounds forming the base material particle included in the electroconductive particle but is not limited thereto. Further, in light of uniforming the structure of the resin coating layer, it is preferred to use the same particle as that used in the base material particle of the electroconductive particle. When non-electroconductive particles are contained, the content ratio of the electrocondcutive particles to the non-electrocondcutive particles is preferably from 1/9 to 7/3.

The non-electroconductive particle in the present invention has a different definition from that of a typical electroconductive particle and has a resistance greater than the resistance of the electroconductive particle mentioned above, i.e., greater than 500 Ωcm.

Further, since the carrier has a volume resistivity of from 10 to 16 [Log(Ωcm)], the improvement effect is significant. When the volume resistivity is too low, carrier attachment on a non-image portion occurs, which is not preferred. In contrast, when the volume resistivity is too high, the edge effect reaches an unacceptable level, which is not preferred. When the volume resistivity is lower than the lower limit of a high resistometer, the volume resistivity is not practically obtained, which is treated as breakdown.

The volume resistivity mentioned in the present invention is a volume resistivity converted from the resistance of a carrier. The resistance of a carrier is measured in a manner that a carrier is set and tapped between electrodes located parallel with a gap of 2 mm, DC 1,000 V is applied between the electrodes, and 300 seconds later, the resistance of the carrier is measured with a high resistometer.

Furthermore, since the weight average particle diameter of a carrier is from 20 to 65 μm, the improvement effect is significant. When the weight average particle diameter is too small, uniformity of the particles deteriorates and a technology to use such a carrier in an image forming apparatus is not established so that problems such as carrier attachment may occur. Thus a particle having such too small a weight average particle diameter is not preferred. In contrast, when the weight average particle diameter is too large, reproducibility of the fine portion of an image is poor and it is thus difficult to obtain quality images. Therefore, a particle having such too large a weight average particle diameter is not preferred.

In addition, since the resin in the resin coating layer of the carrier of the present invention is a silicone resin, the improvement effect is significant. This is because a silicone resin has such a low surface energy that the component of a toner is not easily spent on the carrier and as a result, accumulation of the spent component which causes the layer abrading does not easily proceed.

The silicone resins mentioned in the specification include all the commonly known silicone resins, for example, straight silicones formed of only oragnosiloxane linkage and silicone resins modified with alkyd, polyester, epoxy, acryl, urethane, etc., but are not limited thereto. Specific examples of marketed products of such straight silicone resins include KR271, KR255 and KR152 manufactured by Shin-Etsu ZChemical Co., Ltd., and SR2400, SR2406 and SR2410 manufactured by Dow Corning Toray Silicone Co., Ltd. These silicone resins can be used alone or in combination with a component for cross-linkage reaction and a component for adjusting the amount of charge. Further, specific examples of such modified silicone resins include KR206 (alkyd modified), KR 5208 (acrylic modified), ES1001N (epoxy modified), and KR305 (urethane modified) manufactured by Shin-Etsu Chemical Co., Ltd., and SR2115 (epoxy modified) and SR2110 (alkyd modified) manufactured by Dow Corning Toray Co., Ltd.

Additionally, since the resin in the resin coating layer is an acrylic resin, the improvement effect is significant. This is because, since acrylic resins have a strong attachment property and a low brashiness, acrylic resins have a strong abrasion resistivity, thereby preventing deterioration such as layer abrasion and layer detachment. Therefore, it is possible to stably maintain the resin coating layer. Further, due to its strong adhesive property, it is possible to strongly retain the particles such as the electroconductive particles contained in the resin coating layer. Especially, such acrylic resins exert a strong effect on retaining particles having a larger particle diameter than the layer thickness of the resin coating layer.

The acrylic resins mentioned in this specification represent any resin having an acrylic component and have no specific limit. In addition, such an acrylic resin can be used alone or in combination with at least one other component for linkage reaction such as an amino resin and an acidic catalyst. Such other components are not limited thereto. The amino resins mentioned above represent, for example, a guanamine resin and a melamine resin but are not limited thereto. The acidic catalysts mentioned above represent any compound having a catalyst function. Specific examples of such acidic catalysts include compounds having a reaction group such as a complete alkyl type, a methylol group type, an imino group type and a methylol/imino group type but are not limited thereto.

In addition, since the resins in a resin coating layer are an acrylic resin and a silicone resin, the improvement effect is significant. As mentioned above, acrylic resins have a strong attachment property and a low brashiness, meaning that acrylic resins have an excellent durability. However, since acrylic resins have a high surface energy, a problem may occur such as decrease in the amount of charge caused by accumulation of toner component spent on a carrier when the carrier containing the acrylic resin is used in combination with a toner having a tendency to be spent thereon. This problem can be solved by using a silicone resin together with an acrylic resin since a silicone resin has a low surface toner, meaning that the toner component does not have the tendency of being spent on a carrier so that accumulation of the toner component spent on the carrier does not easily proceed. However, silicone resins have a weak attachment property and a high brashiness, meaning that a silicone resin has a drawback of being a low anti-abrasion property. Therefore, it is essential to use this combination in a balanced manner to obtain a highly-durable resin coating layer by which a toner is not easily spent on a carrier.

With the amount of the resin in a resin coating layer, its content ratio is preferably from 0.1 to 1.5 weight %. When the content ratio is too small, there is almost no resin coating layer present so that such a resin coating layer does not exert a sufficient effect, which is not preferred. In contrast, when too high a content ratio of the resin is not preferred because, as the layer thickness increases, the amount of scraped layer has a tendency to increase. The content ratio of the resin in a resin coating layer mentioned above is represented by the following relationship:

Content ratio of the resin in a resin coating layer (weight %)=[the amount of solid portion of the resin in a resin coating layer/(the amount of solid portion of the resin in a resin coating layer+the amount of the base material particle)]×100

Further, when the ratio (D/h) of the particle diameter (D) of a particle contained in a resin coating layer to the thickness (h) of the resin coating layer satisfies the following relationship: $1<(D/h)<10$, the improvement effect is significant. When the ratio (D/h) of the particle diameter (D) and the layer thickness (h) of a resin coating layer is from greater than 1 to less than 10, the particle projects from the resin coating layer, forming a convex portion on the surface of the carrier. Therefore, when a developer containing such a carrier and a toner is stirred to be friction-charged, the impact of the contact between the carrier and the toner or the carriers themselves can be relaxed. Thereby, it is possible to restrain the layer scraping of the resin in the resin coating layer where the friction-charging occurs.

Further, there are many particles forming convex portions on the surface of a carrier. Such projecting portions on the surface of a carrier exercise a cleaning effect to prevent toner spent by efficiently scraping toner spent components attached thereto when carrier particles abrasively contact with each other. When the ratio (D/h) is too small, the particle submerges in the resin in the resin coating layer. In this case, the effects mentioned above greatly degrade, which is not preferred. When the ratio (D/h) is too high, the contact area between the particle and the resin in the resin coating layer is too small to stably hold the particle. Therefore, the particle easily detaches from the resin in the resin coating layer, which is not preferred.

Further, since the content ratio of the particle is from 10 to 70 weight %, the improvement effect is significant. When the content ratio of the particle is too small, meaning that the content ratio of the particle is smaller than that of the resin in the resin coating layer, the effect of relaxing the impact of the contact on the resin in the resin coating layer is small. Therefore, such a carrier is not preferred because such a carrier does not have a sufficient durability. When the content ratio of the particle is too high, meaning that the content ratio of the particle is too high in comparison with that of the resin in the resin coating layer where charging occurs, the content ratio of the resin in the resin coating layer is too low to have a sufficient charging ability. In addition, since the content ratio of the particle is too large in comparison with that of the resin in the resin coating layer, the resin in the resin coating layer cannot stably hold the particle so that the particle easily detaches from the carrier, which leads to an increase in the variation of the amount of charge, resistance, etc. As a result, such a carrier is not preferred because the durability of the carrier is not sufficient. The content ratio of the particle mentioned above is the content ratio of the total of the elctroconductive particles and non-electroconductive particles, represented by the following relationship:

The content ratio of the particle (weight %)=[the amount of the particle/(the amount of the particle+the total amount of solid portion of the resin in the resin coating layer)]

Further, since the magnetic moment at 1,000 Oe ($10^3/4\pi$ A/m) is from 40 to 90 $Am^2/kg$, the improvement effect is significant. In this range, since the holding power among carrier particles is suitably maintained, toner can quickly disperse (mix) in the carrier or a developer containing the carrier. But when the magnetic moment is too small, carrier attachment occurs due to shortage of the magnetic moment, which is not preferred. In contrast, when the magnetic moment is too large, the filament of a developer formed during development becomes too hard. Therefore, reproducibility of detailed portions of an image is poor and quality images are difficult to obtain, which is not preferred.

Further, by using a developer for use in electrophotography having a toner containing a binder resin and a colorant and the carrier of the present invention, the improvement effect becomes significant. By using the carrier of the present invention, high definition images can be obtained. Further, since the carrier of the present invention has a long life, a developer using the carrier of the present invention has excellent quality. The carrier of the present invention is preferred especially when the carrier of the present invention is used in combination with a toner having a release agent because the carrier of the present invention has a long life.

Further, since the toner is a color toner, the improvement effect is additionally significant. Since the carrier of the present invention does not have carbon black in a resin coating layer, color contamination on an image resulting from layer scraping, etc., does not occur. Therefore, the carrier of the present invention is extremely suitable for a color developer for use in achieving high color reproducibility. The color toner mentioned above represents not only a common color toner used as a single color toner but also yellow, magenta, cyan, red, green, blue toner used as a full color toner.

The toner of the present invention is now described in detail. The toner of the present invention represents any common toner including monochrome toner, color toner and full color toner. For example, such toners include pulverized toners which have been typically used and various kinds of polymerized toners which have recently been used. Further, oilless toners containing a release agent can also be used. Since oilless toners typically contain a release agent, the release agent tends to transfer to the surface of a carrier, which is referred to as spent. However, since the carrier of the present invention has a good anti-toner spent property, the carrier is possible to maintain good quality for an extended period of time. Since an oilless full color toner has such a soft binder resin that the oil less full color toner is said to be easily spent on a carrier, the carrier of the present invention is extremely suitable for such an oilless full color toner.

Any known binder resin can be used as the toner of the present invention. Specific example of such binder resins include homopolymers of styrene and its substitutions such as polystyrene, poly-p-styrene and polyvinyl toluene, styrene-based copolymers such as styrene-p-chlorostyrene copolymers, styrene-propylene copolymers, styrene-vinyl toluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinylmethyl ether copolymers, styrene-vinyl methyl ketone copolymers, styrene-butadiene copolymers, styrene-isopropyl copolymers, and styrene-maleic acid ester copolymers, polymethylmethacrylate, polybutylmethacrylate, polyvinyl chloride, polyvinyl acetate, polyethylene, polyester, polyurethane, epoxy resins, polyvinyl butyral, polyacrylate resins, losin, modified losin, terpene resins, phenol resins, aliphatic or aromatic hydro carbon resins, aromatic petroleum resins. These can be used alone or in combination.

Any known binder resin for pressure fixing can be used. Specific examples of such binder resins for pressure fixing include polyolefins such as low molecular weight polyethylenes and low molecular weight polypropylenes, ethylene-acrylate copolymers, ethylene-acrylate ester copolymers, styrene-methacrylate copolymers, ethylene-methacrylate ester copolymers, ethylene-vinyl chloride copolymers, ethylene-vinyl acetate copolymers, and ionomer resins, epoxy resins, polyester resins, styrene-butadiene copolymers, polyvinyl pyrrolidone, methyl vinyl ether-maleic anhydride, maleic acid modified phenol resins, and phenol modified terpene resins. These can be used alone or in combination and the binder resins for pressure fixing are not limited thereto.

Further, the toner for use in the present invention can include a fixing helper other than the binder resins mentioned above and colorants. Thereby, the toner can be used in a fixing system in which an anti-toner fixation oil is not applied to the fixing roll, i.e., an oilless fixing system. Any known fixing helpers can be used. Specific examples of such known fixing helpers include polyolefins such as polyethylene, and polypropylene, aliphatic metal salts, aliphatic esters, paraffin waxes, amide-based waxes, polyhydric alcohol waxes, silicone varnishes, carnauba waxes and ester waxes but are not limited thereto.

Any pigments and dyes which can be used to obtain each color toner such as yellow toner, magenta toner, cyan toner and black toner can be used for colorants for use in the color toners of the present invention and are not limited to the following examples. Specific examples of yellow dyes include cadmium yellow, Mineral Fast Yellow, nickel titan yellow, Naples yellow, Naphthol Yellow S, Hansa yellow G, Hansa Yellow 10G, Benzidine Yellow GR, Quinoline Yellow Lake, Permanent Yellow NCG and Tartrazine Lake.

Specific examples of orange dyes include molybdenum orange, Permanent Orange GTR, Pyrazolone Orange, Vulcan Orange, Indanthrene Brilliant Orange RK, Benzidine Orange G, and Indanthrene Brilliant Orange GK.

Specific examples of red dyes include red iron oxide, cadmium red, Permanent Red 4R, Lithol Red, Pyrazolone Red, Watching Red Calcium salt, Lake Red D, Brilliant Carmine 6B, Eosin Lake, Rhodamine Lake B, Alizarine Lake, and Brilliant Carmine 3B.

Specific examples of violet dyes include Fast Violet B, and Methyl Violet Lake.

Specific examples of blue dyes include cobalt blue, alkali blue, Victoria Blue Lake, Phthalocyanine Blue, metal-free Phthalocyanine Blue, partially chlorinated Phthalocyanine Blue, Fast Sky Blue, and Indanthrene Blue BC.

Specific examples of green dyes include chrome green, chromium oxide, Pigment Green B and Malachite Green Lake.

Specific examples of black dyes include azine-based dyes such as carbon black, Oil Furnace Black, Channel Black, Lamp Black, acetylene Black, and aniline black, metal salt azo dyes, metal oxides, and composite metal oxides.

These colorants can be used alone or in combination.

The toner such as color toners of the present invention may include a charge controlling agent therein if necessary. Specific examples of such charge controlling agents include nigrosine, azine-based dyes including an alkyl group having 2 to 16 carbon atoms (described in JPP S42-1627), basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000), Lake dyes of the basic dyes, C. I. Solvent Black 8 (C. I. 26150), quaternary ammonium salts such as benzoil methyl hexadecil ammonium chloride and decyl trimethyl chloride, dialkyl tin compounds of, for example, dibutyl and dioctyl, dialkyl tin borate compounds, guanidine derivatives, vinyl-based polymers including an amino group, polyamine resins such as condensation polymers including an amino group, metal complexes of monoazo dyes described in JPPs S41-20153, S43-27596, S44-6397, and S45-26478, metal complexes of Zn, Al, Co, Cr, Fe, etc., for salicylic acid, dialkyl salicylic acid, naphthoic acid, and dicarboxylic acid described in JPPs S55-42752 and S59-7385, sulfonated copper phthalocyanine dyes, organic boron salts, fluorine-containing quaternary ammonium salts, and calixarene-based compounds. For the color toners other than a black toner, it is natural to avoid using a charge controlling agent having a color impairing the desired color tone of the color toner. Therefore, it is preferred to use, for example, a metal salt of a white salicylic acid derivative.

With regard to external additives, an additive such as inorganic particulates of, for example, silica, titan oxide, aluminum, silicon carbide, silicon nitride, and boron nitride, and a resin particulate, can be externally added to a mother toner particle to further improve transferability and durability of a toner. The transferability and durability of a toner are improved because the external additive cloaks a wax, which degrades transferability and durability of the toner, and the contact area is reduced when the surface of a toner is covered with the external additive. The surface of these inorganic particulate is preferred to be hydrophobized. It is thus preferred to use particulates of a metal oxide such as hydrophobized silica and hydrophobized titanium oxide.

As for the resin particulates, it is preferred to use particulates of polymethyl methacrylate and polystyrene prepared by soap free emulsification polymerization method having an average particle diameter of from 0.05 to 1 μm. Further, such inorganic particulates and resin particulates can be used alone or in combination. For example, when hydrophobized silica and hydrophobized titanium oxide are used in combination, a toner can have a stable chargeability against humidity by externally adding the titanium oxide in a larger amount than the hydrophobized silica.

When silica having a specific surface area of from 20 to 50 $m^2/g$ or resin particulates having a relatively large particle diameter in comparison with that of a typically used external additive, which is 1/100 to 1/8 as large as the particle diameter of a toner, is externally added to a toner in combination with the inorganic particulates mentioned above, durability of a toner can be improved. This is because, metal oxide particulates externally added to a toner tend to sink in a mother toner particle when the toner is mixed and stirred with a carrier in a developing device to be charged and served for development, but such an external additive having a larger particle diameter than that of the metal oxide particulates can restrain the metal oxide particulates from sinking in a mother toner particle. The inorganic particulates and the resin particulates mentioned above can be also contained in, i.e., internally added to, a toner. Such internally added particulates can improve transferability and durability of a toner even its improvement effect is not as good as the case of externally added particulates. Further, anti-pulverization property of a toner can be improved by internally adding these particulates. When such particulates are internally and externally added to a toner, the internally added particulates restrain the externally added particulates from sinking in the toner so that the transferability of the toner is stably good and the durability can be improved.

Specific examples of hydrophobizing agents include the following: dimethyl dichlorosilane, trimethyl chlorosilane, methyl trichlorosilane, allyl dimethyl dichlorosilane, allylphenyl dichlorosilane, benzildimethyl chlorosilane, bromomethyl dimethyl chlorosilane, α-chloroethyl trichlorosilane, p-chloroethyl trichlorosilane, chloromethyl dimethyl chlorosilane, chloromethyl trichlorosilane, p-chlorophenyl tricholosilane, 3-chloropropyl trichlorosilane, 3-chloropropyl trimethoxysilane, vinyltriethoxysilane, vinylmethoxysilane, vinyl-tris(β-methoxyethoxy)silane, γ-methacryloxy propyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dibentyl-dichlorosilane, dihexyl-dichlorosilane, dioxyl-dichlorosilane, dinonyl-dichlorosilane, didecyl-dichlorosialne, didodecyl-dichlorosialne, dihexadecyl-dichlorosialne, (4-t-butylphenyl)-octyl-dichlorosialne, dioctyl-dichlorosialne, didecenyl-dichlorosialne, dinonenyl -dichlorosialne, di-2-ethylhexyl-dichlorosialne, di-3,3-dimethylbentyl-dichlorosialne, trihexyl-chlorosialne, trioctyl-chlorosialne, tridecyl-chlorosialne, dioctyl-methyl-chlorosialne, octyl-dimethyl-chlorosialne, (4-t-propylphenyl)-diethyl-chlorosialne, octyltrimethoxysilane, hexamethyldisilazane, hexaethyldisliazane, diethyltetramethyldislazane, hexaphenyldisilazane, and hexatolyldisilazne. Also, titanate-based coupling agents, and aluminum-based coupling agents can be used. In addition, as an external additive for use in improving cleanability, lubricants such as particulates of aliphatic metal salts and polyvinylidene fluoride can be used in combination with other additives.

The core material of the carrier mentioned in the present invention can be suitably selected to the purpose from any products for use in any known double-component carrier for electrophotography, for example, ferrite, Cu—Zn ferrite, Mn ferrite, Mn—Mg ferrite, Mn—Mg—Sr ferrite, magnetite, iron, and nickel, and are not limited thereto.

Any known method such as pulverization methods and polymerization methods can be used to manufacture the toner of the present invention. For example, in the pulverization method, batch-type double rolls, Bumbury's mixer, continuation-type two-axis extruders such as a KTK type two-axis extruder manufactured by Kobe Steel., Ltd., a TEM type two-axis extruder manufactured by Toshiba Machine Co., Ltd., a two-axis extruder manufactured by Asada Iron Works Co., Ltd., a PCM type two-axis extruder manufactured by Ikegai Ltd., and a KEX type two-axis extruder manufactured by Kurimoto Ltd., a continuation-type one axis kneader such as Co-Kneader manufactured by Coperion Buss can be preferably used as a device to mix and knead a toner. The melted and kneaded mixture obtained thereafter is cooled down and pulverized. As to pulverization, the melted and kneaded mixture is coarsely-pulverized by a hammer mill, ROTOPLEX, etc. and then finely-pulverized by a fine pulverizer using a jet air or a mechanical fine pulverizer.

It is preferred to pulverize the mixture in such a manner that the pulverized mixture has an average particle diameter of from 3 to 15 μm. Further, the pulverized mixture is preferred to be adjusted by, for example, an air classifier, in a manner that the size of the adjusted particles is from 5 to 20 μm. Thereafter, external additives are attached to a mother toner particle. The external additives and the mother toner are mixed and stirred by a mixer, etc. While the external additives are pulverized, the surface of the mother toner is covered with the external additives. It is essential to firmly and uniformly attach external additives such as inorganic particulates and resin particulates to a mother toner in terms of durability. The method mentioned above is just for illustration only and is not limiting.

The developer of the present invention can be used in an image forming apparatus including a process cartridge 500 having an image bearing member 100, a developing device 200, a charging member 300 and a cleaning member 400 as illustrated in FIGURE.

In the present invention, among the elements of the image bearing member 100, the developing device 200, the charging member 300 and the cleaning member 400 mentioned above, the image bearing member 100, the developing device 200 and optionally at least one of the charging member 300 and the cleaning member 400 are integrally united as a process cartridge and this process cartridge is detachably attached to the main body of a photocopier, a printer, etc., functioning as an image forming apparatus.

The process cartridge 500 illustrated in FIGURE includes the image bearing 100, the developing device 200, the charging device 300 and the cleaning device 400. The process cartridge 500 operates in the following manner:

(1) The image bearing member 100 is rotationally driven at a predetermined circumference velocity;

(2) The circumference surface of the image bearing member 100 is uniformly charged negatively or positively by the charging device 300 in its rotation cycle;

(3) The circumference surface of the image bearing member 100 is irradiated by an image irradiation device (not shown) such as a slit irradiation device (not shown) and a laser beam scanning irradiation device (not shown);

(4) Consequently a latent electrostatic image is formed on the circumference surface of the image bearing member 100;

(5) The formed latent electrostatic image is developed with toner by the developing device 200;

(6) The developed toner image is transferred by a transfer device (not shown) to a transfer material fed from a paper feeder (not shown) to a portion sandwiched by the image bearing member 100 and a transfer device (not shown) synchronously with the rotation of the image bearing member 100;

(7) The transfer material to which the toner image is transferred is detached from the circumference surface of the image bearing member 100 and guided to an image fixing device (not shown) at which the transferred image is fixed;

(8) The transfer material carrying the fixed image is discharged outside the image forming apparatus (not shown) to which the process cartridge is attached as a copy; and (9) The circumference surface of the image bearing member 100 is then cleaned by the cleaning device 400 which removes the toner particles remaining on the image bearing member 100 after transfer and is further discharged to be ready for the next image forming cycle.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention will be specifically described with reference to examples and comparative examples but is not limited thereto.

Example 1

(Manufacturing of Electroconductive Particles)

(1) Disperse 200 g of aluminum oxide (having an average primary particle diameter of 0.35 μm) in 2.5 litter of water to obtain an aqueous suspension.

(2) Heat the suspension to 80° C.

(3) Add 12 weight % ammonium water and a solution in which 25 g of stannic chloride ($SnCl_4.5H_2O$) is dissolved in 200 ml of 2N hydrochloric acid to the aqueous suspension in such a dripping manner that pH of the aqueous suspension is maintained in the range of 7 to 8.

(4) Further, add 12 weight % ammonium water and a solution in which 75 g of indium chloride ($InCl_3$) and 10 g of stannic chloride ($SnCl_4.5H_2O$) are dissolved in 800 ml of 2N hydrochloric acid to the aqueous suspension in such a dripping manner that pH of the aqueous suspension is maintained in the range of 7 to 8.

(5) Subsequent to adding, filtrate and wash the resultant suspension to obtain a cake of a dye.

(6) Dry the cake at 120° C.

(7) The obtained dried powder is subject to heat treatment in a nitrogen gas stream (1 litter/minute) at 500° C. for 1.5 hours to obtain a desired white-colored electroconductive powder 1.

(Manufacturing of Carrier)

The following was dispersed with a HOMO MIXER for 10 minutes to obtain a silicone resin coating layer forming solution.

| | |
|---|---|
| Silicone resin solution<br>[solid portion: 23 weight % (SR2410: manufactured by Dow Corning Toray Silicone Co., Ltd.)] | 132.2 parts |
| Amino silane<br>[solid portion: 100 weight % (SR6020: manufactured by Dow Corning Toray Silicone Co., Ltd.)] | 0.66 parts |

-continued

| | |
|---|---|
| Electroconductive particle<br>[basic material particle: aluminum, surface treatment: bottom layer = tin dioxide; top layer = indium oxide including tin dioxide, particle diameter: 0.35 μm, Oil absorption amount: 25 ml/100 g, particle powder specific resistance: 3.5 Ωcm] | 31 parts |
| Toluene | 300 parts |

Baked ferrite powder having an average particle diameter of 35 μm was used as a core material. The silicone resin coating layer forming solution mentioned above was applied to the surface of the core material by SPIRA COTA manufactured by Okada Seiko Co. Ltd. with the temperature being 40° C. therein and was dried to have a layer thickness of 0.15 μm. The obtained carrier was left in an electric furnace at 300° C. for an hour to bake the carrier. Subsequent to cooling down, the carrier was pulverized using a sieve having a mesh of 63 μm to obtain [Carrier 1] having a particle content ratio of 50 weight %, D/h of 2.3, a volume resistivity of 12.9 Log(Ωcm) and a magnetization of 68 $Am^2/Kg$.

With regard to measuring the average particle diameter of the core material, an SRA-type microtrack particle size analyzer (manufactured by Nikkiso Co., Ltd.) was used with a range of from 0.7 to 125 μm.

As to measuring the layer thickness of the resin coating layer, the resin coating layer covering the surface of a carrier can be observed by observing the section of the carrier using a transmission electron microscope (TEM). The average value of the layer thickness was determined as the layer thickness.

Magnetization was measured by the following method using VSM-P7-15 manufactured by Toei Industry Co., Ltd.: scale about 0.15 g of a sample material: fill the sample material in a cell having an inner diameter of from 2.4 mm, and a height of 8.5 mm; and measure the magnetization of the sample material under a magnetic field of 1,000 Oersted (Oe).

(Manufacturing Toner)

Mix the following with a HENSCHEL MIXER:

| | |
|---|---|
| Resin in the resin coating layer: polyester resin<br>Number average molecular weight (Mn): 3,800<br>Weight average molecular weight (Mw): 20,000<br>Glass transition temperature (Tg): 60° C.<br>Softening point: 122° C. | 100 parts |
| Colorant: azo-based yellow dye<br>C.I.P.Y. 180 | 5 parts |
| Charge controlling agent: zinc salicylic acid | 2 parts |
| Release agent: carnauba wax (melting point: 82° C.) | 3 parts |

Melt and knead the mixture by a two-axis roll at 120° C. for 40 minutes. Subsequent to cooling down, the resultant was coarsely pulverized by a hammer mill and finely pulverized by an air jet pulverizer to obtain fine powder. The fine powder was classified to prepare a mother toner particle having a weight average particle diameter of 5 μm. Further, 1 part of silica the surface of which was hydrophobized, and 1 part of titan oxide the surface of which was hydrophobized were added based on 100 parts of the mother toner. The resultant was mixed by HENSCHEL MIXER to obtain a yellow toner [Toner 1].

Seven parts of the thus obtained [Toner 1] and 93 parts of [Carrier 1] were mixed and stirred to obtain a developer having a toner density of 7 weight %. The developer was evaluated for color contamination, carrier attachment, edge effect, fine reproduciblity of an image, and durability (reduction in the amount of charge and variance of resistance). The results are shown in Table 1.

The evaluation methods and conditions for examples are described below.

<Carrier Attachment>

(1) Set a developer in a remodeled version of a marketed digital full color printer (IPSiO CX 8200 manufactured by Ricoh. Ltd.);
(2) Fix the background potential at 150 V;
(3) Develop a non-image chart on the surface of the image bearing member; and
(4) Field-vision count the number of carriers attached to the surface of the image bearing member at five places by using a loupe.

The average number of the attached carriers per 100 $cm^2$ is defined as the amount of carrier attachment.

The evaluation is as follows:

Excellent: less than 21 carriers
Good: from 21 to 60 carriers
Fair: from 61 to 80 carriers
Poor: greater than 80 carriers Excellent, Good and Fair are determined to be acceptable. Poor is determined to be not acceptable.

<Edge Effect>

(1) Set a developer in a remodeled version of a marketed digital full color printer (IPSiO CX 8200 manufactured by Ricoh. Ltd.);
(2) Output test patterns having an image having a large area; and
(3) Rank the difference in density between at the central portion of the obtained image pattern and at the edge portion thereof as follows:

Excellent: no difference
Good: slight difference
Fair: acceptable difference
Poor: unacceptable difference Excellent, Good and Fair are determined to be acceptable. Poor is determined to be not acceptable.

<Fine Reproducibility>

With regard to the fine reproducibility of an image, reproducibility of character image portions was evaluated. The evaluation method was as follows:

(1) Set a developer in a remodeled version of a marketed digital full color printer (IPSiO CX 8200 manufactured by Ricoh. Ltd.);
(2) Output character charts having an image area of 5% (the size of a character is about 2 mm×2 mm); and
(3) Evaluate the character reproducibility by image and rank the results as follows:

Excellent
Good
Fair
Unacceptable

Excellent, Good and Fair are determined to be acceptable. Poor is determined to be not acceptable.

<Durability>

(1) Set a developer in a remodeled version of a marketed digital full color printer (IPSiO CX 8200 manufactured by Ricoh. Ltd.);
(2) Evaluate a single color 100,000 image running; and
(3) Determine the durability by decrease in the amount of charge of the carrier and variation of the resistance thereof after the running.

The decrease in the amount of charge mentioned above represents the value obtained as follows:

(1) Obtain a sample of a developer by mixing an initial carrier with a toner with the ratio of 95 to 5 based on weight %;
(2) Measure the amount of charge (Q1) of the sample by a typical blow-off method using a blow-off device (TB-200 manufactured by KYOCERA Chemical Corporation);
(3) Remove the toner from the developer after the running by the blow-off device mentioned above;
(4) Measure the amount of charge (Q2) of the obtained carrier in the same manner as mentioned above; and
(5) Obtain the value of the decrease in the amount of charge by subtracting Q2 from Q1.

The target decrease in the amount of charge is not greater than 10.0 (μc/g). The cause of the decrease in the amount of charge is toner spent on the surface of carrier. Therefore, it is possible to reduce the decrease in the amount of charge by reducing the amount of this toner spent.

The variance of the resistance mentioned above represents the value obtained as follows:

(1) Set an initial carrier between the electrodes of resistance measuring parallel electrodes having a gap of 2 mm;
(2) Apply DC 250 V and 30 seconds later, measure the resistance by a high resistometer;
(3) Convert the measured value to a volume resistivity (R1);
(4) Remove the toner from the developer after the running by the blow-off device mentioned above;
(5) Measure the resistance (R2) of the obtained carrier in the same manner as mentioned above; and
(6) Obtain the variance of the resistance by subtracting R2 from R1.

The target variation of the resistance is not greater than 3.0 (Log(Ωcm)) in absolute value. The causes of the variation of the resistance are scraping of the resin in the resin coating later of a carrier, toner component spent on a carrier, detachment of large particles from its resin coating layer, etc. The variation of the resistance can be restrained by reducing these amounts.

Example 2

The following was dispersed with a HOMO MIXER for 10 minutes to obtain an acrylic resin coating layer forming solution;

| | |
|---|---|
| Acrylic resin solution (solid portion: 50 weight %) | 91.3 parts |
| Guanamine solution (solid portion: 70 weight %) | 28.3 parts |
| Acidic catalyst (solid portion: 40 weight %) | 0.52 parts |
| Eelectroconductive particle (the same as that in Example 1) | 65.7 parts |
| Toluene | 800 parts |

Baked ferrite powder having an average particle diameter of 35 μm was used as a core material. The acrylic resin coating layer forming solution was applied to the surface of the core material by SPIRA COTA manufactured by Okada Seiko Co., Ltd. with the temperature therein being 40° C. and dried to have a layer thickness of 0.15 μm. The obtained carrier was left in an electric furnace at 150° C. for an hour to bake the carrier. Subsequent to cooling down, the obtained carrier ferrite powder bulk was pulverized using a sieve having a mesh of 63 μm to obtain [Carrier 2] having a particle content ratio of 50 weight %, D/h of 2.3, a volume resistivity of 12.5 Log(Ωcm) and a magnetization of 68 $Am^2/Kg$. These thus obtained [Carrier 2] and [Toner 1] were used to form a developer in the same manner as in Example 1. The developer was evaluated and its results are shown in Table 1.

Example 3

[Carrier 3] having a particle content ratio of 50 weight %, D/h of 2.3, a volume resistivity of 12.6 Log(Ωcm) and a magnetization of 68 $Am^2/Kg$ was obtained in the same manner as in Example 2 except that the prescription of the resin coating layer was changed to a mixture of an acrylic resin containing solution and a silicone resin containing solution.

| | |
|---|---|
| Acrylic resin solution (solid portion: 50 weight %) | 39.7 parts |
| Guanamine solution (solid portion: 70 weight %) | 12.4 parts |
| Acidic catalyst (solid portion: 40 weight %) | 0.22 parts |
| Silicone resin solution [solid portion 20 weight % (SR2410: manufactured by Dow Corning Toray Silicone Co., Ltd.)] | 185.8 parts |
| Amino silane [solid portion 100 weight % (SR6020: manufactured by Dow Corning Toray Silicone Co., Ltd.)] | 0.42 parts |
| Eelectroconductive particle (the same as that in Example 1) | |
| Toluene | 800 parts |

Example 4

[Carrier 4] having a particle content ratio of 50 weight %, D/h of 2.3, a volume resistivity of 11.3 Log(Ωcm) and a magnetization of 68 $Am^2/Kg$ was obtained in the same manner as in Example 3 except that the base material particle of the electroconductive particle was changed from the base material particle of Example 3 to titanium oxide having an average primary particle diameter of 0.34 μm.

The electroconductive particle had an oil absorption amount of 25 ml/100 g and a particle powder specific resistance of 2.1 Ωcm.

The thus obtained [Carrier 4] and [Toner 1] were used to form a developer in the same manner as in Example 1. The developer was evaluated and its results are shown in Table 1.

Example 5

[Carrier 5] having a particle content ratio of 50 weight %, D/h of 2.1, a volume resistivity of 11.7 Log(Ωcm) and a magnetization of 68 $Am^2/Kg$ was obtained in the same manner as in Example 3 except that the base material particle of the electroconductive particle was changed from the base material particle of Example 3 to zinc oxide having an average primary particle diameter of 0.32 μm.

The electroconductive particle had an oil absorption amount of 25 ml/100 g and a particle powder specific resistance of 2.3 Ωcm.

The thus obtained [Carrier 5] and [Toner 1] were used to form a developer in the same manner as in Example 1. The developer was evaluated and its results are shown in Table 1.

Example 6

[Carrier 6] having a particle content ratio of 50 weight %, D/h of 2.1, a volume resistivity of 12.6 Log(Ωcm) and a magnetization of 68 $Am^2/Kg$ was obtained in the same manner as in Example 3 except that the base material particle of the electroconductive particle was changed from the base material particle of Example 3 to silicon dioxide having an average primary particle diameter of 0.32 μm.

The electroconductive particle had an oil absorption amount of 25 ml/100 g and a particle powder specific resistance of 4.2 Ωcm.

The thus obtained [Carrier 6] and [Toner 1] were used to form a developer in the same manner as in Example 1. The developer was evaluated and its results are shown in Table 1.

Example 7

[Carrier 7] having a particle content ratio of 50 weight %, D/h of 2.1, a volume resistivity of 12.7 Log(Ωcm) and a magnetization of 68 $Am^2/Kg$ was obtained in the same manner as in Example 3 except that the base material particle of the electroconductive particle was changed from the base material particle of Example. 3 to balium sulfate having an average primary particle diameter of 0.31 μm.

The electroconductive particle had an oil absorption amount of 25 ml/100 g and a particle powder specific resistance of 3.8 Ωcm.

The thus obtained [Carrier 5] and [Toner 1] were used to form a developer in the same manner as in Example 1. The developer was evaluated and its results are shown in Table 1.

Example 8

[Carrier 8] having a particle content ratio of 50 weight %, D/h of 2.4, a volume resistivity of 12.1 Log(Ωcm) and a magnetization of 68 $Am^2/Kg$ was obtained in the same manner as in Example 3 except that the base material particle of the electroconductive particle was changed from the base material particle of Example 3 to zirconium oxide having an average primary particle diameter of 0.36 μm.

The electroconductive particle had an oil absorption amount of 25 ml/100 g and a particle powder specific resistance of 3.1 Ωcm.

The thus obtained [Carrier 8] and [Toner 1] were used to form a developer in the same manner as in Example 1. The developer was evaluated and its results are shown in Table 1.

Example 9

[Carrier 9] having a particle content ratio of 65 weight %, D/h of 2.3, and a magnetization of 68 $Am^2/Kg$ was obtained in the same manner as in Example 1 except that the volume resistivity of the carrier was changed to 9.6 Log(Ωcm). To decrease the volume resistivity of the carrier, the electroconductive particle was changed as follows.

Base material particle: aluminum

Surface treatment: bottom layer: tin dioxide/upper layer: indium oxide containing tin dioxide;

Particle diameter: 0.35 μm;

Amount of oil absorption: 25 ml/100 g;

Powder specific resistance: 1.2 Ωcm.

The thus obtained [Carrier 9] and [Toner 1] were used to form a developer in the same manner as in Example 1. The developer was evaluated and its results are shown in Table 1.

Example 10

[Carrier 10] having a particle content ratio of 50 weight %, D/h of 2.3, a volume resistivity of 12.8 Log(Ωcm) and a magnetization of 66 $Am^2/Kg$ was obtained in the same manner as in Example 3 except that the weight average particle diameter of the carrier was changed to 17 μm.

The thus obtained [Carrier 10] and [Toner 1] were used to form a developer in the same manner as in Example 1. The developer was evaluated and its results are shown in Table 1.

Example 11

[Carrier 11] having a particle content ratio of 50 weight %, D/h of 2.3, a volume resistivity of 12.6 Log(Ωcm) and a magnetization of 69 $Am^2/Kg$ was obtained in the same manner as in Example 3 except that the weight average particle diameter of the carrier was changed to 70 μm.

The thus obtained [Carrier 11] and [Toner 1] were used to form a developer in the same manner as in Example 1. The developer was evaluated and its results are shown in Table 1.

Example 12

[Carrier 12] having a particle content ratio of 50 weight %, D/h of 0.8, a volume resistivity of 11.9 Log(Ωcm) and a magnetization of 68 $Am^2/Kg$ was obtained in the same manner as in Example 3 except that the average primary particle diameter of the base material particle, i.e., aluminum oxide particle, of the electroconductive particle, was changed to 0.12 μm. Characteristics of the electroconductive particle were as follows:

Base material particle: aluminum

Surface treatment: bottom layer: tin dioxide/upper layer: indium oxide containing tin dioxide;

Particle diameter: 0.12 μm;

Amount of oil absorption: 42 ml/100 g;

Powder specific resistance: 2.4 Ωcm.

The thus obtained [Carrier 12] and [Toner 1] were used to form a developer in the same manner as in Example 1. The developer was evaluated and its results are shown in Table 1.

Example 13

[Carrier 13] having D/h of 2.3, a volume resistivity of 15.2 Log(Ωcm) and a magnetization of 68 $Am^2/Kg$ was obtained in the same manner as in Example 3 except that the particle content ratio was changed to 5 weight %.

The thus obtained [Carrier 13] and [Toner 1] were used to form a developer in the same manner as in Example 1. The developer was evaluated and its results are shown in Table 1.

Example 14

[Carrier 14] having D/h of 2.3, a volume resistivity of 10.5 Log(Ωcm) and a magnetization of 68 $Am^2/Kg$ was obtained in the same manner as in Example 3 except that the particle content ratio was changed to 75 weight %.

The thus obtained [Carrier 14] and [Toner 1] were used to form a developer in the same manner as in Example 1. The developer was evaluated and its results are shown in Table 1.

Example 15

[Carrier 15] having a particle content ratio of 50 weight %, D/h of 2.3, and a volume resistivity of 14.3 Log(Ωcm) in the same manner as in Example 3 except that its magnetization was changed to 35 $Am^2/Kg$ using a baked low magnetized ferrite having a particle diameter of 35 μm.

The thus obtained [Carrier 15] and [Toner 1] were used to form a developer in the same manner as in Example 1. The developer was evaluated and its results are shown in Table 1.

Example 16

[Carrier 16] having a particle content ratio of 50 weight %, D/h of 2.3, and a volume resistivity of 11.2 Log(Ωcm) in the same manner as in Example 3 except that its magnetization was changed to 93 $Am^2/Kg$ using a baked high magnetized ferrite having a particle diameter of 35 μm.

The thus obtained [Carrier 16] and [Toner 1] were used to form a developer in the same manner as in Example 1. The developer was evaluated and its results are shown in Table 1.

Example 17

[Carrier 17] having a particle content ratio of 50 weight %, D/h of 2.3, and a volume resistivity of 13.2 Log(Ωcm) was obtained in the same manner as in Example 3 except that electroconductive particles and non-electroconductive particles were used as follows.

Electroconductive particles

[base material particle: aluminum, surface treatment: bottom layer; tin dioxide/upper layer; indium oxide containing tin dioxide, particle diameter: 0.35 μm, amount of oil absorption: 25 ml/100 g, powder specific resistance: 3.5 Ωcm]

Non-electroconductive particles

[base material particle: aluminum, surface treatment: none, particle diameter: 0.34 μm, powder specific resistance: $10^{14}$ Ωcm]

The thus obtained [Carrier 17] and [Toner 1] were used to form a developer in the same manner as in Example 1. The developer was evaluated and its results are shown in Table 1.

Example 18

Aluminum oxide particles having an average primary particle diameter of 0.40 μm were subject to heat treatment in nitrogen gas stream at 500° C. for 1.5 hours. Thereafter, the obtained baked resultant was pulverized and γ-meracaptopropyltrimethoxysilane having 4 weight % was added thereto while the resultant was stirred by HENSCHEL MIXER heated to 70° C. Further, a white-colored electroconductive powder A was prepared in the same manner as in Example 1 except that the process of heating at 100° C. for one hour was added.

[Carrier Resin Coating Layer]

The following was dispersed with a HOMO MIXER for 10 minutes to obtain a silicone resin coating layer forming solution.

| | |
|---|---|
| Silicone resin solution [solid portion: 23 weight % (SR2410: manufactured by Dow Corning Toray Silicone Co., Ltd.)] | 132.2 parts |
| Amino silane [solid portion: 100 weight % (SR6020: manufactured by Dow Corning Toray Silicone Co., Ltd.)] | 0.66 parts |
| Eelectroconductive particle A [basic material particle: aluminum, surface treatment: bottom layer = tin dioxide; toplayer = indium oxide including tin dioxide, particle diameter: 0.40 μm, amount of carbon: 0.33 weight %, particle powder specific resistance: 3.7 Ωcm] | 31 parts |
| Toluene | 300 parts |

Baked ferrite powder having an average particle diameter of 35 μm was used as a core material. The silicone resin coating layer forming solution mentioned above was applied to the surface of the core material by SPIRA COTA manufactured by Okada Seiko Co., Ltd. with the temperature being 40° C. therein and dried to have a layer thickness of 0.15 μm. The obtained carrier was baked in an electric furnace at 240° C. for an hour. Subsequent to cooling down, the obtained carrier was pulverized using a sieve having a mesh of 63 μm to obtain [Carrier 18] having a particle content ratio of 50 weight %, D/h of 2.3, a volume resistivity of 12.9 Log(Ωcm) and a magnetization of 68 $Am^2/Kg$.

The thus obtained [Carrier 18] and [Toner 1] were used to form a developer in the same manner as in Example 1. The developer was evaluated and its results are shown in Table 1.

Example 19

A white-colored electroconductive powder B was prepared in the same manner as in preparation of the white-colored electroconductive powder A of Example 18 except that γ-aminopropyltriethoxy silane having 3.5 weight % was added.

| | |
|---|---|
| Silicone resin solution [solid portion: 23 weight % (SR2410: manufactured by Dow Corning Toray Silicone Co., Ltd.)] | 132.2 parts |
| Amino silane [solid portion: 100 weight % (SR6020: manufactured by Dow Corning Toray Silicone Co., Ltd.)] | 0.66 parts |
| Eelectroconductive particle B [particle diameter: 0.40 μm, amount of carbon: 0.27 weight %, particle powder specific resistance: 4.7 Ωcm] | 5.7 parts |
| Toluene | 300 parts |

Baked ferrite powder having an average particle diameter of 35 μm was used as a core material. The solution mentioned above of forming a silicone resin coating layer was applied to the surface of the core material by SPIRA COTA manufactured by Okada Seiko Co., Ltd. with the temperature being 40° C. therein and dried to have a layer thickness of 0.15 μm. The obtained carrier was baked in an electric furnace at 240° C. for an hour. Subsequent to cooling down, the obtained carrier was pulverized using a sieve having a mesh of 63 μm to obtain [Carrier 18] having a particle content ratio of 50 weight %, D/h of 2.3, a volume resistivity of 12.1 Log(Ωcm) and a magnetization of 68 $Am^2/Kg$.

The thus obtained [Carrier 19] and [Toner 1] were used to form a developer in the same manner as in Example 1. The developer was evaluated and its results are shown in Table 1.

Comparative Example 1

[Carrier 20] having a particle content ratio of 50 weight %, D/h of 5.0, a volume resistivity of 12.9 Log(Ωcm) and a magnetization of 68 $Am^2/Kg$ was prepared in the same manner as in Example 1 except that the amount of oil absorption of the electroconductive particle was changed to 5 ml/100 g and the particle diameter thereof was changed to 0.75 μm. Characteristics of the electroconductive particle were as follows:

Basic material particle: aluminum

Surface treatment: bottom layer: tin dioxide/upper layer: indium oxide containing tin dioxide;

Powder specific resistance: 3.6 Ωcm.

The thus obtained [Carrier 20] and [Toner 1] were used to form a developer in the same manner as in Example 1. The developer was evaluated and its results are shown in Table 1.

Comparative Example 2

[Carrier 21] having a particle content ratio of 50 weight %, D/h of 2.1, a volume resistivity of 15.2 Log(Ωcm) and a magnetization of 68 $Am^2/Kg$ was prepared in the same manner as in Example 4 except that the electroconductive particle was changed to titanium dioxide particles having no surface treatment. Characteristics of the electroconductive particle were as follows:

Basic material particle: titanium dioxide

Surface treatment: none

Powder specific resistance: 2.1 Ωcm

The thus obtained [Carrier 21] and [Toner 1] were used to form a developer in the same manner as in Example 1. The developer was evaluated and its results are shown in Table 1.

TABLE 1

| | | | | Durability | |
|---|---|---|---|---|---|
| | Edge effect | Carrier attach-ment | Fine reproduci-bility Of image | Decrease in amount of charge (μc/g) | Variation in resistance [Log (Ωcm)] |
| Example 1 | E | E | E | 1.9 | 1.5 |
| Example 2 | E | E | E | 1.5 | 0.7 |
| Example 3 | E | E | E | 1.2 | 0.5 |
| Example 4 | E | G | E | 3.2 | 0.5 |
| Example 5 | E | G | E | 3.5 | 0.6 |
| Example 6 | E | E | E | 2.9 | 0.7 |
| Example 7 | E | E | E | 3.3 | 0.9 |
| Example 8 | E | E | E | 3.3 | 0.7 |
| Example 9 | E | F | E | 3.5 | 0.8 |
| Example 10 | E | F | G | 5.8 | 1.4 |
| Example 11 | E | E | F | 2.6 | 1.3 |
| Example 12 | E | G | E | 8.9 | 2.6 |
| Example 13 | F | E | G | 9.4 | 2.8 |
| Example 14 | E | G | G | 3.2 | 1.7 |
| Example 15 | F | F | F | 4.1 | 1.6 |
| Example 16 | E | E | F | 5.4 | 1.9 |
| Example 17 | E | E | E | 1.7 | 0.8 |
| Example 18 | E | E | E | 1.8 | 1.4 |
| Example 19 | E | E | E | 1.4 | 0.8 |

TABLE 1-continued

| | Edge effect | Carrier attach-ment | Fine reproduci-bility Of image | Durability: Decrease in amount of charge (μc/g) | Durability: Variation in resistance [Log (Ωcm)] |
|---|---|---|---|---|---|
| Comparative Example 1 | E | E | E | Variation in resistance reached 3.5 at 70,000th images, and no further measurement was performed | |
| Comparative Example 2 | P | Not evaluated due to its strong edge effect | | | |

In Table 1, E represents Excellent, G represents Good, F represents Fair and P represents Poor.

In Table 1, E represents Excellent, G represents Good, F represents Fair and P represents Poor.

As seen in Table 1, the results of Examples 1 to 19, which satisfy the conditions of the present invention, are within the target ranges of all the evaluation items, i.e., edge effect, carrier attachment, fine reproducibility of image, decrease in the amount of charge and variation in resistance.

To the contrary, in the case of Comparative Example 1, in which the amount of oil absorption of the electroconductive particle was 5 ml/100 g, the effect of resistance adjustment was not maintained over an extended period of time so that the variation in resistance was outside the range of the target value, i.e., 3.5 [Log(Ωcm)] at 70,000th image. Therefore, further running was suspended because the developer was not suitable for practical use.

Further, in the case of Comparative Example 2, in which the electroconductive particle was titanium dioxide to which no surface treatment was applied, its edge effect was outside the target range, meaning that the developer could not be practically used. Because of the poor result for the edge effect, the developer was not evaluated for the rest of the evaluation items.

This document claims priority and contains subject matter related to Japanese Patent Application No. 2004-221546, filed on Jul. 29, 2004, the entire contents of which are hereby incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A carrier, comprising:
a core material; and
a resin coating layer located overlying at least a part of a surface of the core material, comprising;
resin; and
electroconductive particles having an oil absorption amount of from 10 to 300 ml/100 g, comprising:
a base material particle; and
an electroconductive coating layer located overlying a surface of the base material particle, comprising:
an underlayer comprising tin dioxide; and
an upper layer comprising indium oxide and tin dioxide, located overlying the underlayer.

2. The carrier according to claim 1, wherein the base material particle comprises at least one of aluminum oxide, titanium dioxide, zinc oxide, silicon dioxide, barium sulfate, and zirconium oxide.

3. The carrier according to claim 1, wherein the electroconductive particles have a powder specific resistance not greater than 200 Ωcm.

4. The carrier according to claim 1, wherein a content of the electroconductive particles is from 10 to 70 weight % based on total weight of the resin coating layer.

5. The carrier according to claim 1, wherein the resin coating layer further comprises non-electroconductive particles.

6. The carrier according to claim 5, wherein a content A of the electroconductive particles and a content B of the non-electroconductive particles are from 10 to 70 weight % based on total weight of the resin coating layer.

7. The carrier according to claim 6, wherein a content ratio (A/B) of the electrocondcutive particles to the non-electroconductive particles is from 1/9 to 7/3.

8. The carrier according to claim 1, wherein the carrier has a volume resistivity of from 10 to 16 [Log(Ωcm)].

9. The carrier according to claim 1, wherein the carrier has a weight average particular diameter of from 20 to 65 μm.

10. The carrier according to claim 1, wherein the resin coating layer comprises at least one of silicone resin and acrylic resin.

11. The carrier according to claim 1, wherein a ratio (D/h) of a particle diameter (D) of the electroconductive particles to a thickness (h) of the resin coating layer satisfies the following relationship:

$$1<(D/h)<10.$$

12. The carrier according to claim 1, wherein a magnetic moment of the carrier is from 40 to 90 ($Am^2/Kg$) for 1,000 Oe or 1,000/4π (A/m).

13. The carrier according to claim 1, wherein a surface of the electroconductive particles is treated by a silane-coupling agent, and an amount of carbon in the electroconductive particle is from 0.1 to 0.5 weight % based on a weight of the electroconductive particle.

14. A developer, comprising:
a toner, comprising:
a binder resin; and
a colorant; and
a carrier, comprising:
a core material; and
a resin coating layer located overlying at least a part of a surface of the core material, comprising;
resin; and
electroconductive particles having an oil absorption amount of from 10 to 300 ml/100 g, comprising:
a base material particle; and
an electroconductive coating layer located overlying a surface of the base material particle, comprising:
an underlayer comprising tin dioxide; and
an upper layer comprising indium oxide and tin dioxide, located overlying the underlayer.

15. The developer according to claim 14, wherein the toner is a color toner, wherein the toner is selected from the group consisting of yellow toner, magenta toner, cyan toner, and black toner.

16. An image forming method, comprising:
forming a latent electrostatic image on an image bearing member;
visualizing the latent electrostatic image with a developer comprising:
a toner, comprising:
a binder resin; and a colorant; and a carrier, comprising:

a core material; and a resin coating layer located overlying at least a part of a surface of the core material, comprising;

resin; and electroconductive particles having an oil absorption amount of from 10 to 300 ml/100 g, comprising:

a base material particle; and an electroconductive coating layer located overlying a surface of the base material particle, comprising:

an underlayer comprising tin dioxide; and an upper layer comprising indium oxide and tin dioxide, located overlying the underlayer;

transferring the visualized image to a recording material; and fixing the visualized image.

* * * * *